United States Patent [19]

Roof

[11] Patent Number: 4,867,865

[45] Date of Patent: Sep. 19, 1989

[54] CONTROLLING $H_2S$ IN FUEL OILS

[75] Inventor: Glen L. Roof, Sugar Land, Tex.

[73] Assignee: Pony Industries, Inc., New York, N.Y.

[21] Appl. No.: 217,539

[22] Filed: Jul. 11, 1988

[51] Int. Cl.[4] ..... C10G 29/20

[52] U.S. Cl. ..... 208/236; 208/208 R; 585/860

[58] Field of Search ..... 208/207, 208 R, 23 B; 585/860

[56] References Cited

U.S. PATENT DOCUMENTS

| | | | |
|---|---|---|---|
| 3,159,570 | 12/1962 | Petty | 208/207 |
| 4,412,913 | 11/1983 | Moote et al. | 208/207 |
| 4,594,147 | 6/1986 | Roof et al. | 208/207 |

*Primary Examiner*—Patrick P. Garvin
*Assistant Examiner*—E. D. Irzinski
*Attorney, Agent, or Firm*—Adrian J. Good

[57] ABSTRACT

The hydrogen sulfide content of the atmosphere over sour heavy fuel oils is controlled by the addition of choline to the fuel oil.

8 Claims, No Drawings

CONTROLLING $H_2S$ IN FUEL OILS

FIELD OF THE INVENTION

The present invention pertains to a method for controlling the concentration or amount of $H_2S$ in the atmosphere of sour heavy fuel oils derived from petroleum and to maintain the specification of such oils with respect to $H_2S$.

BACKGROUND OF THE INVENTION

Petroleum based heavy fuels are typically produced by the thermal distillation of crude petroleum in apparatus referred to as crude oil distillation towers. Distillates from such towers include gas, gasoline, naphtha, kerosene, gas oil, and diesel oil. The residue or bottoms from the distillation can either be coked in delayed coking drums at temperatures between 900° to 930° F. to produce coke and distilled overhead products or can be shipped and sold directly to be used as fuel in boilers on ships or in power or steam plants.

Industrial fuel oils can also consist of one or more of the following products derived from petroleum: vacuum tower bottoms, catalytically cracked light or heavy gas oils and catalytically cracked clarified oil. A No. 6 fuel oil is an example of such a product. It will typically have a boiling point of 660° F., a specific gravity greater than 1.0° and 45° F. pour point. These products can contain significant amounts of $H_2S$.

When "sour" crude oils, i.e., those containing sulfur-containing components, are distilled, such components distribute into both the various distillation products and also to the residue or bottoms in the distillation unit. In the overhead or distillate products, the sulfur components of the crude oil contain mercaptans (thiols) and organodisulfides, but little if any $H_2S$. Numerous proposals have been made to "sweeten" such sour distillate products by treatment with a variety of additives. Disclosures illustrative of these are contained in U.S. Pat. Nos. 2,671,048 issued 2 Mar. 1954 (addition of phenylenediamine together with an organic base compound); 4,430,196 issued 2 February 1984 (addition of dimethylaminoethanol and/or dimethylisopropanolamine to the crude oil or the refinery stream products), and 4,594,147 issued 10 June 1986 (treating sour gasoline with choline).

None of the above proposals deal with the problem of $H_2S$ in the atmosphere above or associated with sour heavy fuel oils. When such oils are to be used as fuel in industrial boilers or in electric utility steam plants or elsewhere, the presence of large amounts of $H_2S$ in the atmosphere above or associated with the oil during transit in barges or ships, or in storage in refinery tanks or user tanks, constitutes a hazard to personnel who are in the vicinity of the storage or transport facilities. Typically, the $H_2S$ specification for such fuel oils in 100 ppm or less. Since some of such oils may contain up to 5,000 ppm of $H_2S$, there is a need for an efficacious and economical method for reducing the $H_2S$ concentration in the sour fuel oil atmosphere without affecting the burning properties of the fuel.

SUMMARY OF THE INVENTION

The invention concerns a method for maintaining the $H_2S$ content of the atmosphere above or associated with sour heavy fuel oils derived from petroleum sources within acceptable limits to avoid health hazards to personnel. This method comprises treating such fuel oils with an effective amount of choline base. The treatment is performed by adding an appropriate amount of choline base to such oils and heating the mixture to a temperature below the decomposition temperature of choline for a time sufficient to reduce the $H_2S$ content of the fuel oil atmosphere to acceptable or specification grade levels; under 100 ppm $H_2S$ is a typical specification. This is accomplished without impairing the burning characteristics or properties of the fuel oil.

DETAILED DESCRIPTION OF THE INVENTION

The invention comprises the discovery that choline base can be added to sour heavy fuel oils derived from petroleum in amounts effective to control the level or concentration of $H_2S$ in the atmosphere above or associated with such oils. This results in reducing the $H_2S$ content of such atmospheres from as high as 5000 ppm, and often within the range of 120 to 4500 ppm, down to 100 ppm or less which satisfies a typical specification for such fuels. Such treatment does not impair the fuel burning characteristics or properties of such fuel oils.

Choline is described in Merck Index, 10th Edition, Merck & Co. (1983) and in the J. Org. Chem., Vol. 41, No. 23,3373 (1976). It is typically represented as $Me_3N^{\oplus}—CH_2CH_2—OH$. The term choline as used herein and in the appended claims also includes derivatives of choline represented as $Me_3N^{\oplus}$-$CH_2CH_2$-$OHOR^-$ where R=alkyl ($C_1$ to $C_{20}$).

The amount of choline base added to the sour heavy fuel oil is directly proportional to the amount of $H_2S$ present in the atmosphere above or associated with the fuel oil. The choline base is mixed with and dissolved in the oil and then the choline-containing oil is maintained at ambient temperature but is preferably heated within the temperature range of 100° to 225° F., for a time until the $H_2S$ in the fuel oil atmosphere is reduced to an acceptable or specification grade level. A preferred procedure is to heat the choline-containing fuel oil at a temperature of 180° F. for 2 hours. The temperature should be below the decomposition temperature of the choline base or choline derivative. When choline base itself is used, the heating temperature of the choline-containing oil should be below 230° F.

The amount of choline to be used and/or the heat treatment time employed can readily be determined by those skilled in the art by periodically or routinely analyzing the fuel oil atmosphere for $H_2S$.

The following examples illustrate preferred procedures for performing the method of the invention.

Three samples (A, B and C) of sour heavy marine fuel oil and one sample of low $H_2S$ fuel oil (D) were obtained from a gulf coast oil refinery. These had specific gravity numbers above 1.0 and atmospheric $H_2S$ contents or values as follows:

| Fuel Oil Sample | $H_2S$ ppm($\nu$) |
|---|---|
| A | 700 |
| B | 120 |
| C | 4500 |
| D* | 3000* |

*Controlled amount of $H_2S$ added to oil

Samples of the above fuel oils were mixed with varying amounts of choline base and heated for 2 hours at 180° F. in a closed vessel, after which the atmosphere in the vessel was analyzed for $H_2S$ using the Drager method.

| Example No. | Fuel Oil Sample | ppm(l) Choline | $H_2S$ ppm(v) |
|---|---|---|---|
| 1 | A | 500 | 300 |
| 2 | A | 1000 | 25 |
| 3 | A | 5000 | 10 |
| 4 | B | 1000 | 0 |
| 5 | C | 500 | 250 |
| 6 | C | 1000 | 90 |
| 7 | C | 2000 | 0 |
| 8 | D | 126 | 2200 |
| 9 | D | 500 | 40 |

The above data show that the amount of choline base to be used depends on the amount of $H_2S$ present in the sour fuel oil atmosphere and may be used as guidelines for choline addition to fuel oils having a wide range of atmospheric $H_2S$.

What is claimed is:

1. The method of maintaining the $H_2S$ content of the atmosphere above heavy sour fuel oils within acceptable limits which comprises treating such fuel oils with an effective amount of choline base at a temperature below the decomposition temperature of choline base.

2. The method according to claim 1 wherein the amount of choline used to treat the fuel oil is directly proportional to the amount of $H_2S$ present in the atmosphere above the fuel oil.

3. The method according to claim 1 wherein the treating temperature is between 82° C. (180° F.) and 107° C. (225° F.).

4. The method according to claim 1 wherein the treating temperature is about 82° C. (180° F.).

5. The method according to claim 1 wherein the fuel oil atmosphere contains up to 5000 ppm of $H_2S$.

6. The method according to claim 3 wherein the fuel oil atmosphere contains up to 5000 ppm of $H_2S$.

7. The method of claim 4 wherein the fuel oil atmosphere contains up to 5000 ppm of $H_2S$.

8. The method according to claim 1 wherein the treating temperature is between 38° C. (100° F.) and 107° C. (225° F.).

* * * * *